US008676486B2

(12) United States Patent
Kadowaki et al.

(10) Patent No.: US 8,676,486 B2
(45) Date of Patent: Mar. 18, 2014

(54) VEHICULAR INFORMATION PROCESSING DEVICE

(75) Inventors: Yoshinori Kadowaki, Toyota (JP); Yoh Sato, Miyoshi (JP); Kazunori Kagawa, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 77 days.

(21) Appl. No.: 13/320,425

(22) PCT Filed: Jul. 27, 2009

(86) PCT No.: PCT/JP2009/063356

§ 371 (c)(1),
(2), (4) Date: Nov. 14, 2011

(87) PCT Pub. No.: WO2011/013189

PCT Pub. Date: Feb. 3, 2011

(65) Prior Publication Data

US 2012/0065876 A1 Mar. 15, 2012

(51) Int. Cl.
*G08G 1/09* (2006.01)

(52) U.S. Cl.
USPC ..... 701/300; 701/117

(58) Field of Classification Search
None
See application file for complete search history.

(56) References Cited

U.S. PATENT DOCUMENTS

| | | | | |
|---|---|---|---|---|
| 5,983,161 | A | 11/1999 | Lemelson et al. | |
| 5,999,880 | A | 12/1999 | Okada et al. | |
| 6,965,829 | B2 * | 11/2005 | Yamadaji et al. | 701/301 |
| 8,532,862 | B2 * | 9/2013 | Neff | 701/25 |
| 2004/0122587 | A1 | 6/2004 | Kanemitsu | |
| 2004/0193372 | A1 | 9/2004 | MacNeille et al. | |
| 2008/0059050 | A1 * | 3/2008 | Lin et al. | 701/117 |
| 2009/0033540 | A1 * | 2/2009 | Breed et al. | 342/29 |
| 2009/0088925 | A1 | 4/2009 | Sugawara et al. | |
| 2009/0228172 | A1 * | 9/2009 | Markyvech et al. | 701/36 |
| 2010/0245171 | A1 * | 9/2010 | Zeng | 342/357.34 |
| 2012/0166059 | A1 | 6/2012 | Aso | |

FOREIGN PATENT DOCUMENTS

| | | | |
|---|---|---|---|
| CN | 101396968 | | 4/2009 |
| DE | 10 2009 011 259 | A1 | 11/2009 |
| JP | 10-148665 | A | 6/1998 |
| JP | 2003-337029 | A | 11/2003 |
| JP | 2004 199389 | | 7/2004 |
| JP | 2007 085909 | | 4/2007 |
| JP | 2009 031926 | | 2/2009 |
| JP | 2009-145167 | A | 7/2009 |
| JP | 2011-14977 | A | 1/2011 |
| WO | WO 2011/013203 | A1 | 2/2011 |

OTHER PUBLICATIONS

International Search Report Issued Oct. 27, 2009 in PCT/JP09/063356 Filed Jul. 27, 2009.
German Office Action issued Apr. 13, 2012 in patent application No. 11 2009 005 097.2.
Chinese Office Action issued Nov. 21, 2013 in Chinese Patent Application No. 200980160517.4.

* cited by examiner

*Primary Examiner* — Michael J Zanelli
(74) *Attorney, Agent, or Firm* — Oblon, Spivak, McClelland, Maier & Neustadt, L.L.P.

(57) ABSTRACT

Disclosed is a vehicular information processing device which performs a predetermined process of a host vehicle on the basis of reference positional information acquired from positional information of another vehicle within a predetermined positional range. When there are a plurality of other vehicles within a predetermined positional range, representative positional information is acquired on the basis of a plurality of pieces of positional information obtained from the plurality of other vehicles, and the predetermined process is performed with the acquired representative positional information as the reference positional information.

8 Claims, 9 Drawing Sheets

VEHICULAR INFORMATION PROCESSING DEVICE

TECHNICAL FIELD

The present invention relates to a vehicular information processing device which performs a predetermined process of a host vehicle on the basis of reference positional information acquired from positional information of another vehicle within a predetermined positional range.

BACKGROUND ART

Heretofore, there have been attempts to control traveling of a vehicle in a traffic flow, thereby improving traffic on a road and reducing a traffic jam. For example, a case where communication system-mounted vehicles which are communicable with other vehicles by vehicle-to-vehicle communication are included in a traffic flow at a predetermined ratio is considered. In this case, the communication system-mounted vehicles share information on vehicle speed or current positions and perform collaborative traveling control, thereby indirectly controlling the motions of vehicles therebetween and effectively reducing a traffic jam. In the traveling control in collaboration with other communication system-mounted vehicles, it is necessary for each communication system-mounted vehicle to specify other communication system-mounted vehicles with which to collaborate.

That is, it is necessary for the communication system-mounted vehicle to acquire positional information of other communication system-mounted vehicles. As a technique for acquiring positional information of other vehicles, an another vehicle position detection device described in Patent Literature 1 is known. The position detection device calculates the difference between the received GPS coordinates in the host vehicle and the position coordinates after correction in the host vehicle calculated by map matching as a GPS error, and corrects the GPS coordinates acquired from another vehicle using the GPS error to calculate the accurate position of another vehicle.

CITATION LIST

Patent Literature

[Patent Literature 1] Japanese Unexamined Patent Application Publication No. 2007-085909

SUMMARY OF INVENTION

Technical Problem

However, in the position detection device of Patent Literature 1, the GPS error to be calculated depends on the road shape at the time of map matching and, for example, an error in the road traveling direction is not easily corrected. For this reason, when a plurality of communication system-mounted vehicles are lined up in the road traveling direction, it is impossible for the position detection device to specify a vehicle with which to collaborate. As a result, it becomes impossible to perform collaborative traveling control of the communication system-mounted vehicles with sufficient precision.

Accordingly, an object of the invention is to provide a vehicular information processing device capable of specifying positional information of another vehicle necessary for a predetermined process even when there are a plurality of other vehicles within a predetermined range.

Solution to Problem

The invention provides a vehicular information processing device which performs a predetermined process of a host vehicle on the basis of reference positional information acquired from positional information of another vehicle within a predetermined positional range. When there are a plurality of other vehicles within a predetermined positional range, representative positional information is acquired on the basis of a plurality of pieces of positional information obtained from the plurality of other vehicles, and the predetermined process is performed with the acquired representative positional information as the reference positional information.

With this vehicular information processing device, when there are a plurality of other vehicles within the predetermined positional range, the representative positional information which is acquired on the basis of a plurality of pieces of positional information of the plurality of other vehicles is set as the reference positional information. Thus, even when there are a plurality of other vehicles within the predetermined positional range, it is possible to specify the reference positional information necessary for the predetermined process.

The representative positional information may be acquired by averaging a plurality of pieces of positional information obtained from the plurality of other vehicles.

With this configuration, it is possible to use the average position of the plurality of other vehicles as the reference positional information necessary for the predetermined process.

In this case, when the distance between the plurality of other vehicles is equal to or smaller than a predetermined distance, the representative positional information may be acquired by averaging a plurality of pieces of positional information obtained from the plurality of other vehicles, and when the distance between the plurality of other vehicles is larger than the predetermined distance, positional information closest to the host vehicle from among a plurality of pieces of positional information may be acquired as the representative positional information.

With this configuration, when a plurality of other vehicles are close to each other at a distance smaller than the predetermined distance, the average position of the positions of the plurality of other vehicles is set as the reference positional information, when a plurality of other vehicles are not close to each other at a distance smaller than the predetermined distance, the position of another vehicle closest to the host vehicle from among the plurality of other vehicles is set as the reference positional information, and the predetermined process is then performed.

The representative positional information may be acquired on the basis of the precision of each of a plurality of pieces of positional information obtained from the plurality of other vehicles.

With this configuration, with regard to the reference positional information for the predetermined process, it is possible to set positional information having the highest precision from among the positional information of the plurality of other vehicles as the reference positional information.

In this case, when the distance between the plurality of other vehicles is equal to or smaller than a predetermined distance, on the basis of the precision of each of a plurality of pieces of positional information obtained from the plurality of other vehicles, positional information which is expected to have the highest precision from among the plurality of pieces of positional information may be acquired as the representative positional information, and when the distance between the plurality of other vehicles is larger than the predetermined distance, positional information closest to the host vehicle from among the plurality of pieces of positional information may be acquired as the representative positional information.

With this configuration, when a plurality of other vehicles are close to each other at a distance smaller than the predetermined distance, the positional information which is expected to have the highest precision from among the positions of the plurality of other vehicles is set as the reference positional information, when a plurality of other vehicles are not close to each other at a distance smaller than the predetermined distance, the position of another vehicle closest to the host vehicle from among the plurality of other vehicles is set as the reference positional information, and then the predetermined process is performed.

The representative positional information may be acquired on the basis of the timing of acquiring each of a plurality of pieces of positional information obtained from the plurality of other vehicles.

With this configuration, with regard to the reference positional information necessary for the predetermined process, for example, it is possible to set positional information acquired recently from among the positional information of the plurality of other vehicles as the reference positional information.

In this case, when the distance between the plurality of other vehicles is equal to or smaller than a predetermined distance, on the basis of the timing of acquiring each of a plurality of pieces of positional information obtained from the plurality of other vehicles, positional information having the most recent acquisition time from among the plurality of pieces of positional information may be acquired as the representative positional information, and when the distance between the plurality of other vehicles is larger than the predetermined distance, positional information closest to the host vehicle from among the plurality of pieces of positional information may be acquired as the representative positional information.

With this configuration, when a plurality of other vehicles are close to each other at a distance smaller than the predetermined distance, the most recent position from among the positions of the plurality of other vehicles is set as the reference positional information, when a plurality of other vehicles are not close to each other at a distance smaller than the predetermined distance, the position of another vehicle closest to the host vehicle from among the plurality of other vehicles is set as the reference positional information, and then the predetermined process is performed.

When the number of other vehicles within the predetermined positional range is one, the predetermined process may be performed with the positional information of another vehicle as the reference positional information.

Another vehicle may be communicable with the host vehicle by vehicle-to-vehicle communication, and the positional information of another vehicle may be acquired by vehicle-to-vehicle communication with another vehicle.

With this configuration, when a plurality of pieces of positional information relating to the plurality of other vehicles are acquired by vehicle-to-vehicle communication, the representative positional information which is acquired on the basis of the plurality of pieces of positional information is set as the reference positional information. Thus, even when there are a plurality of other vehicles within the predetermined positional range, it is possible to specify the reference positional information necessary for the predetermined process.

Advantageous Effects of Invention

According to the vehicular information processing device of the invention, even when there are a plurality of other vehicles within the predetermined range, it is possible to specify the positional information of another vehicle necessary for the predetermined process.

DESCRIPTION OF EMBODIMENTS

Figure 1:
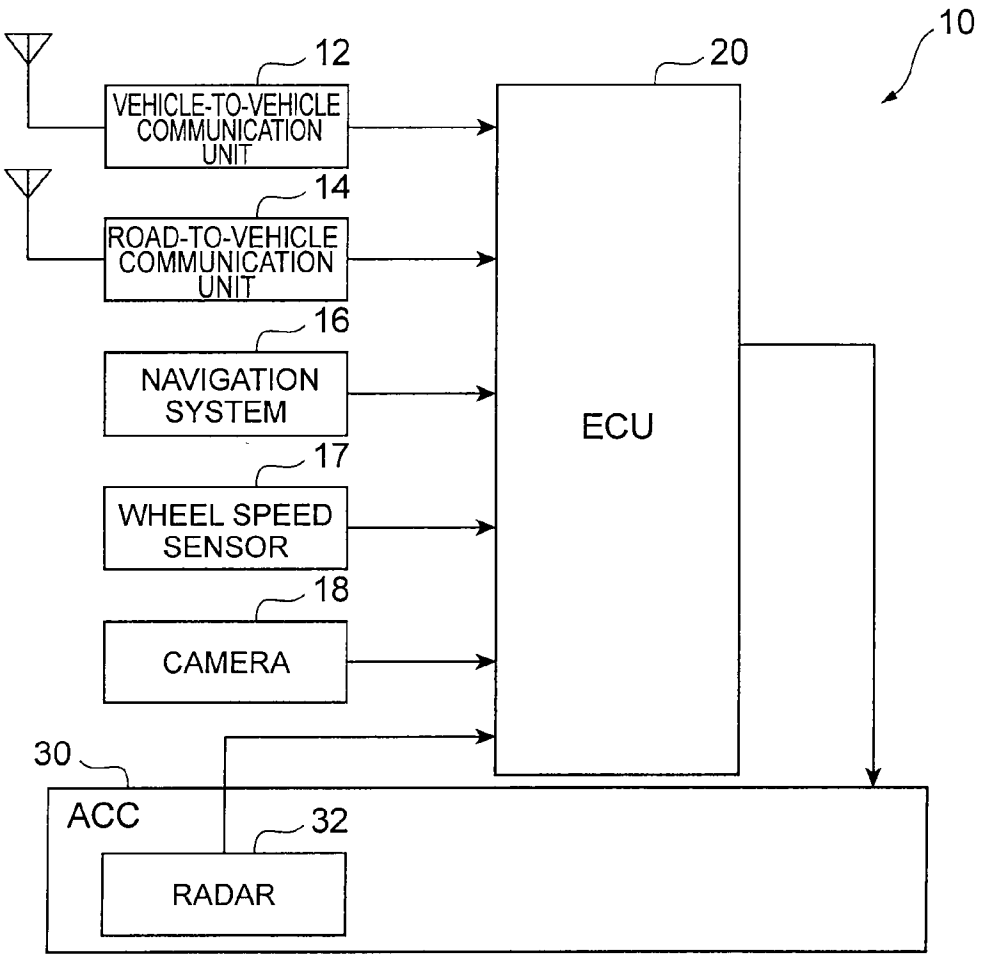
FIG. 1 is a block diagram showing the configuration of a vehicle control system according to an embodiment of a vehicular information processing device of the invention.

Hereinafter, a vehicle control system 10 which is a preferred embodiment of a vehicular information processing device according to the invention will be described in detail with reference to the drawings. The vehicle control system 10 is mounted in a vehicle and is used to perform vehicle control for improving traffic on a road. As shown in FIG. 1, the vehicle control system 10 of this embodiment includes a vehicle-to-vehicle communication unit 12, a road-to-vehicle communication unit 14, a navigation system 16, a wheel speed sensor 17, a camera 18, an ECU (Electronic Control Unit) 20, and an ACC (Adaptive Cruise Control) 30.

The vehicle-to-vehicle communication unit 12 is used to transmit or receive information, such as the positions or speed of system-mounted vehicles other than a host vehicle, or whether vehicle control for preventing a traffic jam is ON or OFF, by vehicle-to-vehicle communication.

The road-to-vehicle communication unit 14 is used to receive information, such as traffic on a road or the vehicle speed of a vehicle which is traveling on the road, from roadside facilities, such as an optical beacon communication unit. For example, a traffic monitoring system on a road measures an inter-vehicle distance, a traffic flow rate, a vehicle speed, or the like on the road by a camera or the like on the road. The measured information is provided to a vehicle by an optical beacon communication unit or the like. Each vehicle which is traveling on a road includes the road-to-vehicle communication unit 14, and can receive information, such as an inter-vehicle distance, a traffic flow rate, or a vehicle speed, on the road on which the host vehicle is traveling.

The navigation system 16 includes a GPS which receives signals from a plurality of GPS (Global Positioning System) satellites by a GPS receiver, and determines the position of the host vehicle from the difference between the signals, and a map information DB (Data Base) which stores map information in the host vehicle. The navigation system 16 is used to perform route guidance of the host vehicle and to acquire information relating to a point, such as a sag in front of the host vehicle, at which a decrease in the vehicle speed is caused. For example, the navigation system 16 detects the relative position of the host vehicle with respect to the sag and outputs the relative position to the ECU 20.

The wheel speed sensor 17 measures the wheel speed of the host vehicle and outputs the wheel speed to the ECU 20 as an electrical signal. The ECU 20 can calculate the vehicle speed of the host vehicle on the basis of the signal from the wheel speed sensor 17. The camera 18 captures video in front of the host vehicle. The ECU 20 performs a video process based on a signal from the camera 18, thereby recognizing a lane in which the host vehicle is traveling.

The ECU 20 is an electronic control unit which performs overall control of the vehicle control system 10, and is mainly constituted by, for example, a computer including a CPU, a ROM, and a RAM. Information from the vehicle-to-vehicle communication unit 12, the road-to-vehicle communication unit 14, the navigation system 16, the wheel speed sensor 17, and the camera 18 as electrical signals is input to the ECU 20. For example, information relating to the relative position of the host vehicle with respect to the sag from the navigation system 16 and information relating to the relative position and relative speed of another vehicle around the host vehicle from a radar 32 of the ACC 30 are input. The ECU 20 performs various information processes on the basis of the respective kinds of input information. For example, the ECU 20 outputs traveling control command values, such as a target vehicle speed, an acceleration/deceleration G, and a target inter-vehicle distance, to the ACC 30 on the basis of information input from the navigation system 16 and the ACC 30.

The ACC 30 has the radar 32 which detects the relative position and relative speed of another vehicle around the host vehicle. The ACC 30 performs traveling control on the basis of the traveling control command values from the ECU 20 such that the host vehicle reaches the target vehicle speed, the acceleration/deceleration G, and the target inter-vehicle distance. The radar 32 can measure a forward inter-vehicle distance of the host vehicle (the inter-vehicle distance between the host vehicle and a vehicle which is traveling directly in front).

Subsequently, a process which is performed by the vehicle control system 10 to reduce a traffic jam will be described.

Figure 2:
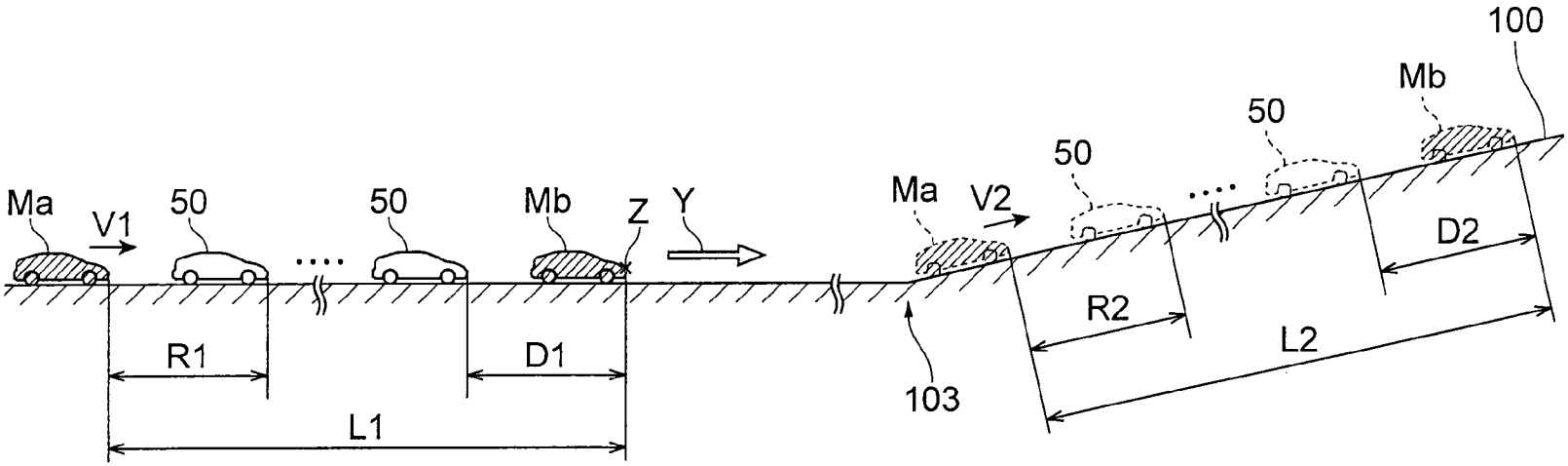
FIG. 2 is a diagram showing a traffic flow including a vehicle in which the vehicle control system of FIG. 1 is mounted.

As shown in FIG. 2, a state where vehicles having the vehicle control system 10 mounted therein are mixed with vehicles, which are traveling on a road 100 in an arrow Y direction, at a predetermined ratio is considered. Hereinafter, a vehicle in which the vehicle control system 10 is mounted is called "a system-mounted vehicle", and a vehicle in which no vehicle control system 10 is mounted is called "a system-unmounted vehicle". A host vehicle Ma and a vehicle Mb which is traveling in front in the same lane as the host vehicle Ma are system-mounted vehicles, and all vehicles 50 which are traveling between the host vehicle Ma and the vehicle Mb are system-unmounted vehicles. The system-mounted vehicles (for example, the host vehicle Ma and the vehicle Mb) can perform vehicle-to-vehicle communication using the vehicle-to-vehicle communication unit 12, and can share various kinds of information, such as the vehicle speed and the current position.

Now, a sag 103 at which a gentle downhill is changed to an uphill is present in front of the host vehicle Ma on the road 100. At the sag 103, since the vehicle speed decreases while being unnoticed by a driver, a traffic jam is likely to occur. Accordingly, when the presence of the sag 103 in front is recognized by the navigation system 16, the vehicle control system 10 of the host vehicle Ma performs traveling control of the host vehicle Ma in advance ahead of the sag 103 so as to reduce a traffic jam.

Hereinafter, traveling control when the vehicle control system 10 of the host vehicle Ma recognizes the sag 103 in front will be described.

Figure 3:
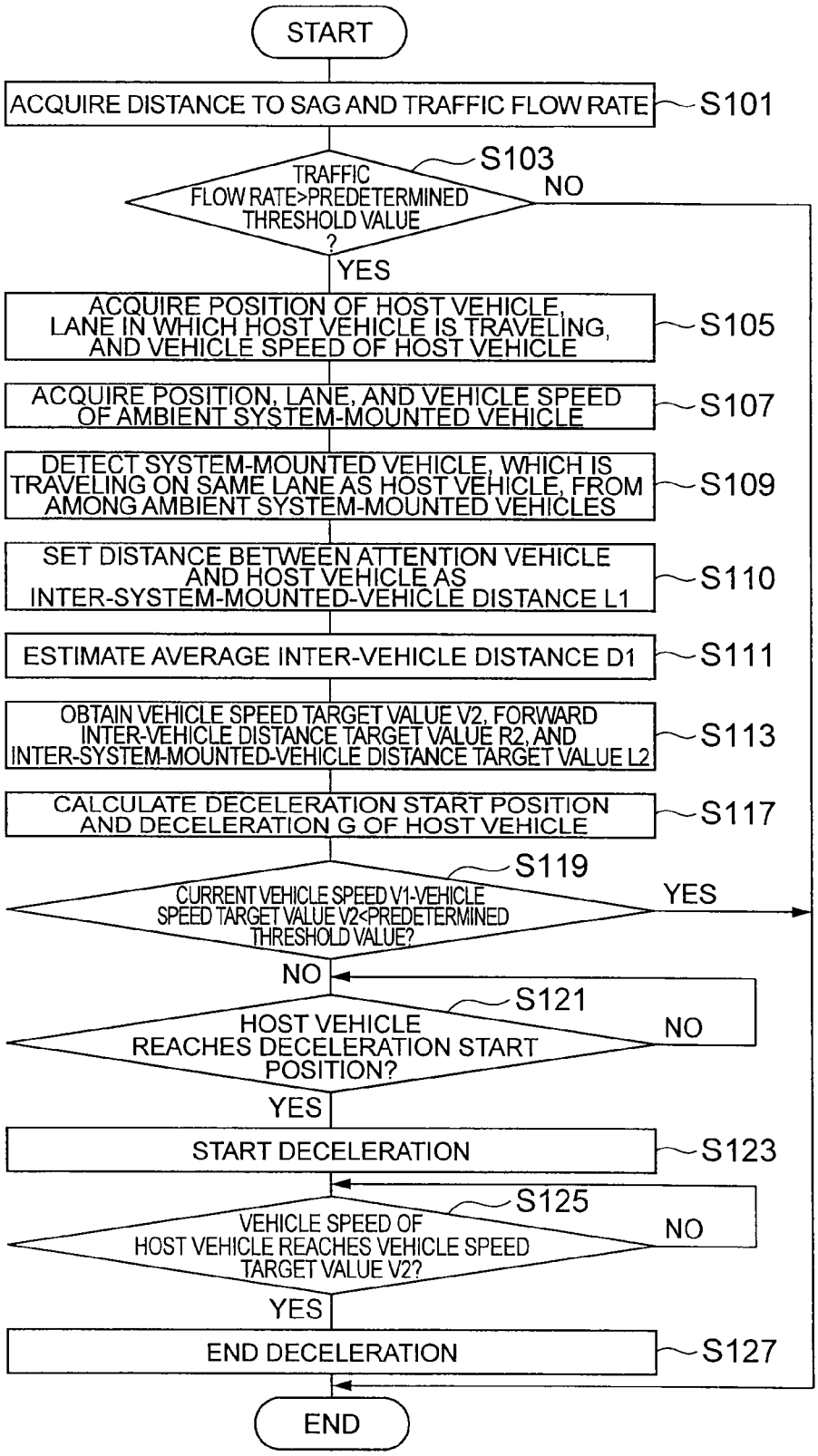
FIG. 3 is a flowchart showing a process which is performed by the vehicle control system of FIG. 1.

As shown in FIG. 3, the ECU 20 of the vehicle control system 10 acquires a traffic flow rate on the road 100 from the road-to-vehicle communication unit 14, and acquires the distance with respect to the sag 103 from the navigation system 16 (S101). When the acquired traffic flow rate exceeds a predetermined threshold value (Yes in S103), the next process is performed. When the acquired traffic flow rate is equal to or smaller than the predetermined threshold value (No in S103), since it is thought that there is a low possibility of the occurrence of a traffic jam on the sag 103, in particular, a process ends without performing traveling control.

When the traffic flow rate exceeds a predetermined threshold value (Yes in S103), the ECU 20 detects the position of the host vehicle Ma on the basis of information from the navigation system 16, detects a lane, in which the host vehicle Ma is traveling, on the basis of video information from the camera 18, and detects a vehicle speed V1 of the host vehicle Ma on the basis of information from the wheel speed sensor (S105).

Next, the ECU 20 acquires positional information, traveling lane information and vehicle speed information of each system-mounted vehicle, which is traveling around the host vehicle Ma, by vehicle-to-vehicle communication using the vehicle-to-vehicle communication unit 12 (S107). Usually, information for a plurality of system-mounted vehicles around the host vehicle is acquired. The ECU 20 detects system-mounted vehicles, which are traveling in the same lane as the host vehicle Ma, on the basis of positional information, lane information, and vehicle speed information for a plurality of vehicles (S109). In the example of FIG. 2, the vehicle Mb is detected. It is assumed that there is no system-mounted vehicle other than the vehicle Mb in front of the host vehicle Ma at a position within a distance range in which vehicle-to-vehicle communication can be performed.

Hereinafter, the vehicle control system 10 of the host vehicle Ma performs traveling control of the host vehicle Ma on the basis of the positional relationship between the host vehicle Ma and the vehicle Mb paying attention to the vehicle Mb. A system-mounted vehicle for attention in front in traveling control of the host vehicle Ma may be called "an attention vehicle". The distance between the host vehicle Ma and the attention vehicle Mb is called "an inter-system-mounted-vehicle distance". The ECU 20 calculates the distance between the host vehicle Ma and the attention vehicle Mb on the basis of the difference between positional information of the host vehicle Ma and positional information of the attention vehicle Mb, and sets the distance as the inter-system-mounted-vehicle distance L1 (S110).

Figure 4:
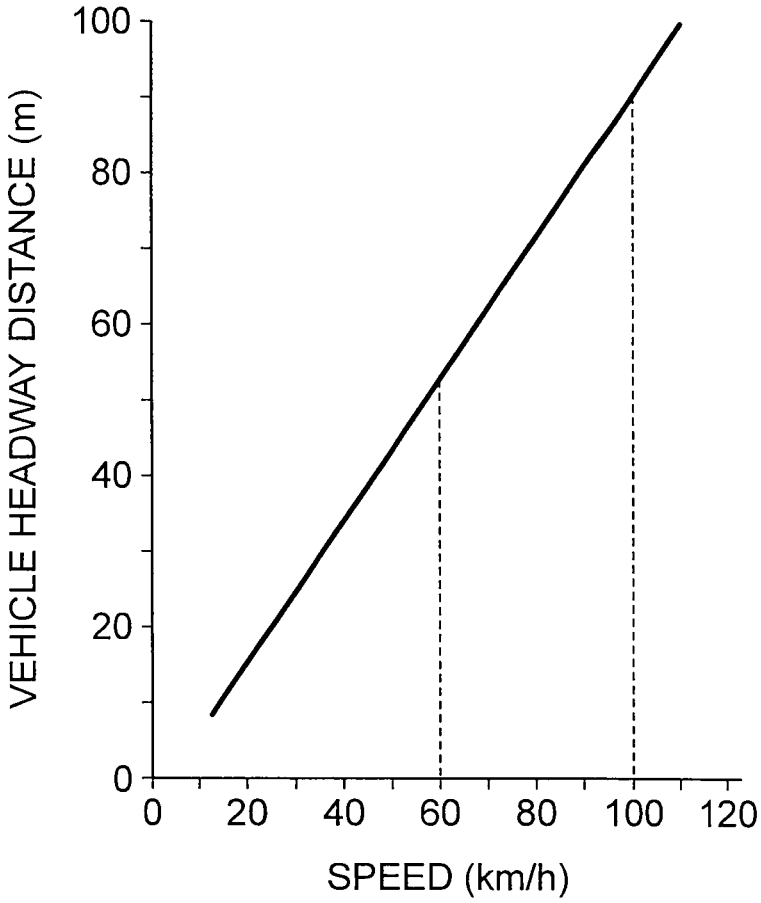
FIG. 4 is a graph showing the relationship between the speed of a vehicle and a vehicle headway distance in a usual traffic flow.

Next, the ECU 20 of the host vehicle Ma estimates the number x of system-unmounted vehicles 50 between the host vehicle Ma and the attention vehicle Mb, and an average inter-vehicle distance (hereinafter, referred to as "average inter-vehicle distance") D1 between the vehicles 50 in a zone between the host vehicle Ma and the attention vehicle Mb (S111). With regard to the average inter-vehicle distance D1, information measured by the traffic monitoring system on the road 100 may be used as it is. In this case, the average inter-vehicle distance D1 can be acquired from road-side facilities, such as an optical beacon communication unit, by the road-to-vehicle communication unit 14. As another method, the average inter-vehicle distance D1 may be estimated assuming that the inter-vehicle distance is tightest in the zone between the host vehicle Ma and the attention vehicle Mb. That is, if the relationship (search report for improvement in fuel consumption efficiency, Energy Conservation Center) between the vehicle speed and the vehicle headway distance shown in FIG. 4 is referenced, it is possible to estimate the average inter-vehicle distance D1 on the basis of the vehicle speed of the host vehicle Ma. In this case, since the inter-vehicle distance is sufficiently larger than the vehicle length of each vehicle, even when it is regarded to be the vehicle headway distance=the inter-vehicle distance, there is no practical problem. The number x of vehicles is estimated by x=L1/D1−1 on the basis of the average inter-vehicle distance D1 and the inter-system-mounted-vehicle distance L1.

Figure 5:
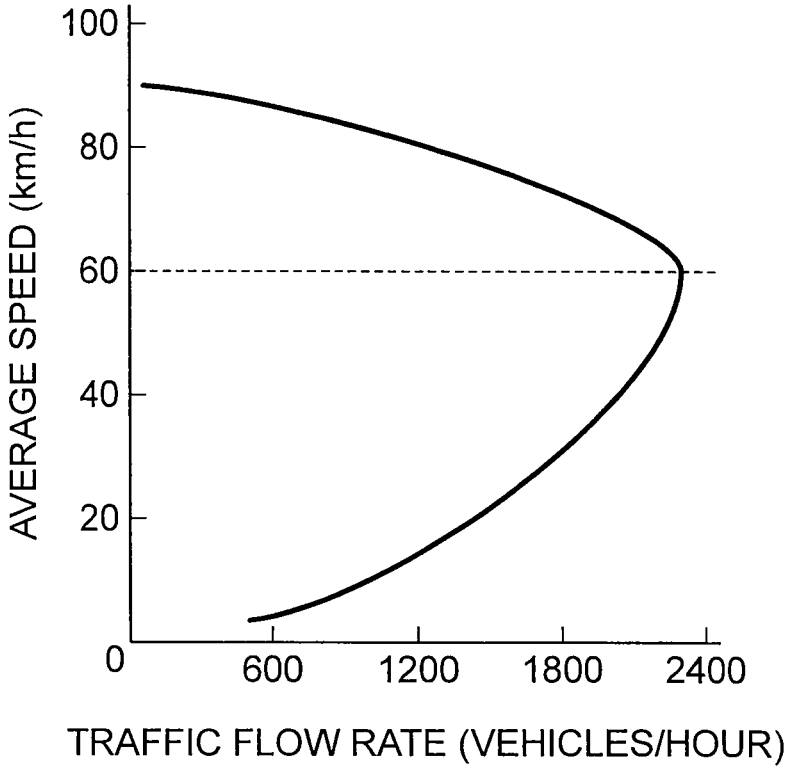
FIG. 5 is a graph showing the relationship between a traffic flow rate and the average speed of a vehicle in a usual traffic flow.

Next, the ECU 20 derives a desired vehicle speed (vehicle speed target value) V2, a desired forward inter-vehicle distance (forward inter-vehicle distance target value) R2, and a desired inter-system-mounted-vehicle distance (inter-system-mounted-vehicle distance target value) L2 when the host vehicle Ma has reached the sag 103 (S113). The target values V2, R2, and L2 are selected taking into consideration the conditions on which a traffic jam is unlikely to occur in the vehicles 50 between the host vehicle Ma and the attention vehicle Mb. That is, the vehicle speed target value V2 references the relationship (search report for improvement in fuel consumption efficiency, Energy Conservation Center) between the average speed and the traffic flow rate shown in FIG. 5, and uses the speed at which the largest traffic flow rate is obtained. In other words, as shown in FIG. 5, the vehicle speed target value V2=60 km/h such that the traffic flow rate has a peak. With regard to the forward inter-vehicle distance target value R2, a distance is selected in response to the vehicle speed target value V2 such that deceleration of the vehicle does not propagate backward. That is, in order that deceleration does not propagate in the case of the vehicle speed of 60 km/h, in general, since the inter-vehicle distance of 60 m is necessary (see FIG. 4), the forward inter-vehicle distance target value R2=60 m.

The inter-system-mounted-vehicle distance target value L2 is obtained by L2=x·D2+R2. Here, D2 is a desired average inter-vehicle distance when the host vehicle Ma has reached the sag 103. If it is assumed that the inter-vehicle distance is tightest in the zone between the host vehicle Ma and the attention vehicle Mb, the average inter-vehicle distance D2 is obtained from FIG. 4. That is, from FIG. 4, the desired average inter-vehicle distance D2 is 60 m in response to the vehicle speed target value V2.

Next, the ECU 20 acquires a deceleration profile of the attention vehicle Mb by vehicle-to-vehicle communication with the attention vehicle Mb. The deceleration profile includes information on the current position, the current vehicle speed, the target position, the target vehicle speed, and the deceleration G of the attention vehicle Mb. The ECU 20 determines the deceleration profile of the host vehicle Ma on the basis of the deceleration profile of the attention vehicle Mb such that the inter-system-mounted-vehicle distance when having reached the sag 103 becomes the target value L2, and the vehicle speed of the host vehicle Ma when having reached the sag 103 becomes the target value V2. That is, the deceleration start position and the deceleration G of the host vehicle Ma are determined so as to satisfy the conditions of the target values L2 and V2 (S117). When the relationship between the current vehicle speed V1 and the vehicle speed target value V2 of the host vehicle Ma is V1−V2<predetermined threshold value, the ECU 20 ends the process without performing subsequent traveling control (S119).

Next, the ECU 20 monitors information from the navigation system 16, and when the host vehicle Ma has reached the deceleration start position (S121), starts the deceleration of the host vehicle Ma (S123). Thereafter, the vehicle speed of the host vehicle Ma has reached the vehicle speed target value V2 (S125), the deceleration of the host vehicle Ma ends (S127), and the process ends. The deceleration profile of the host vehicle Ma obtained in the process S117 is transmitted from the host vehicle Ma by vehicle-to-vehicle communication and used by a backward vehicle which handles the host vehicle Ma as an attention vehicle.

With the above-described process of the vehicle control system 10 of the host vehicle Ma, when the host vehicle Ma has reached the sag 103, the inter-system-mounted-vehicle distance becomes L2, and the vehicle speed of the host vehicle Ma becomes V2. Thus, the vehicle speed and the average inter-vehicle distance of the vehicles 50 in front of the host vehicle Ma having reached the sag 103 have values such that a traffic jam is unlikely to occur. As a result, according to the vehicle control system 10, even when the sag 103 which is likely to cause a traffic jam is present, it is possible to suppress a traffic jam.

As will be understood from the above description, in order to effectively suppress a traffic jam by traveling control of the host vehicle Ma, it is necessary to accurately set the inter-system-mounted-vehicle distance L1. On the other hand, there may be a case where a plurality of system-mounted vehicles which are traveling in the same lane as the host vehicle Ma are detected within a predetermined distance range in front of the host vehicle Ma. The predetermined distance range is the range of a distance at which the host vehicle Ma can perform vehicle-to-vehicle communication. As described above, if the number of system-mounted vehicles detected in S107 and S109 is one, the position of the system-mounted vehicle serves as the origin (referred to as a reference position Z) of the inter-system-mounted-vehicle distance L1. For this reason, when a plurality of system-mounted vehicles are detected, it is difficult to specify the reference position Z.

Thus, when there are a plurality of system-mounted vehicles within a distance range in which vehicle-to-vehicle communication can be performed, the vehicle control system 10 determines a representative position W of the plurality of system-mounted vehicles as follows. The determined representative position W is applied to the reference position Z, and the above-described traveling control is performed. Specifically, when there are a plurality of system-mounted vehicles, after S107 and S109, a process from S501 of FIG. 6, instead of S110, is performed.

In S107 and S109, when positional information for a plurality of vehicles Mj and Mk (in this case, description will be provided as to positional information for two vehicles) is obtained (Yes in S501), the ECU 20 calculates the distance S between the vehicle Mj and the vehicle Mk (S503). Specifically, the ECU 20 references the relationship between the vehicle speed and the vehicle headway distance shown in FIG. 4, obtains the inter-vehicle distance corresponding to the vehicle speed of the vehicles Mj and Mk, and sets the inter-vehicle distance as the distance S. The ECU 20 compares the calculated distance S and a predetermined distance threshold value S0 (S505). The distance threshold value S0 is a value which is expressed by Expression (1).

$$\text{Distance Threshold Value } S0 = \text{Average Inter-Vehicle Distance } D1 + \text{GPS positioning error} \quad (1)$$

As the GPS positioning error in Expression (1), the value of 30 to 50 m, which is a general positioning error inherent in the GPS, is appropriately selected. As the average inter-vehicle distance D1 in Expression (1), information measured by the traffic monitoring system on the road 100 is received by the road-to-vehicle communication unit 14 and used.

In S505, if the distance S is larger than the distance threshold value S0 (Yes in S505), it is thought that, even taking into consideration the GPS positioning error in the positional information, it is possible to determine which of the vehicles Mj and Mk is closer to the host vehicle Ma. Positional information closer to the host vehicle Ma from among positional information Pj and Pk of the vehicles Mj and Mk is set as the representative position W (S507). The representative position W is applied to the reference position Z (S509), the distance between the reference position Z and the position of the host vehicle Ma is applied to the above-described inter-system-mounted-vehicle distance L1 (S510), and the process from S111 of FIG. 3 is performed. That is, in this case, an attention vehicle candidate closer to the host vehicle Ma from among the two attention vehicle candidates Mj and Mk is used as the above-described attention vehicle Mb.

Figure 7:
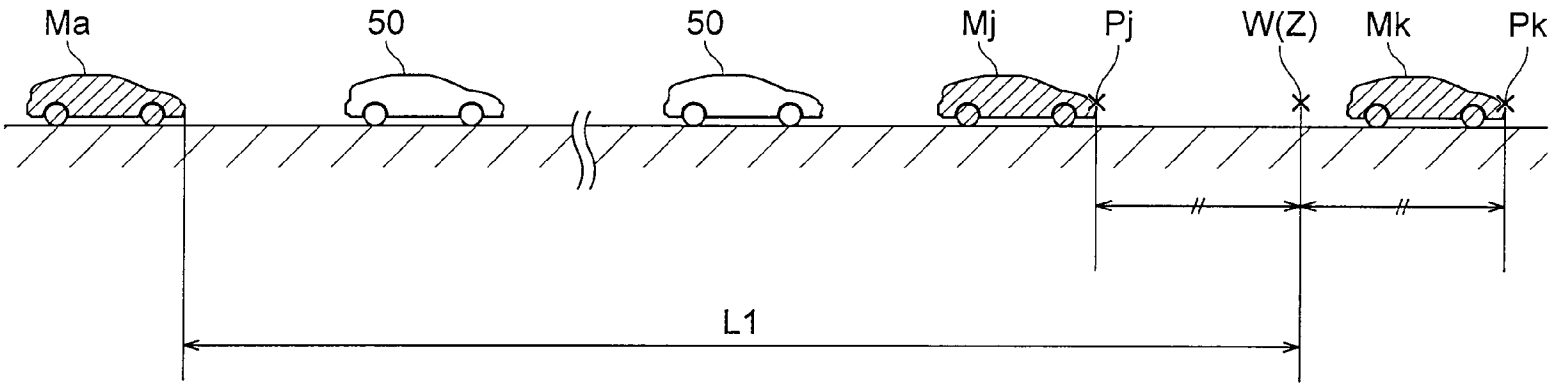
FIG. 7 is a diagram showing a representative position W which is calculated in a part of the process of FIG. 6.

If the distance S is equal to or smaller than the distance threshold value S0 (No in S505), it is thought that, taking into consideration the GPS positioning error in the positional information, it is impossible to determine which of the vehicles Mj and Mk is closer to the host vehicle Ma. Thus, as shown in FIG. 7, the average of the positional information Pj and Pk is calculated, and the average position is set as the representative position W (S517). In this case, the arithmetic average of the GPS coordinate values acquired by the navigation systems 16 of the vehicles Mj and Mk is calculated. The representative position W is applied to the reference position Z (S509), the distance between the reference position Z and the position of the host vehicle Ma is applied to the above-described inter-system-mounted-vehicle distance L1 (S510), and the process from S111 of FIG. 3 is performed. That is, in this case, the two attention vehicle candidates Mj and Mk are combined and regarded as one virtual attention vehicle Mb which is present in the center position of the vehicles Mj and Mk.

As described above, in S107 and S109, when the positional information Pj and Pk for a plurality of vehicles Mj and Mk is obtained (Yes in S501), the representative position W of a plurality of vehicles is determined, and the distance between the representative position W and the host vehicle Ma is set as the inter-system-mounted-vehicle distance L1. Thus, even when there are a plurality of system-mounted vehicles within a distance, at which vehicle-to-vehicle communication can be performed, in front in the same lane as the host vehicle Ma, it is possible to specify the reference position Z and the inter-system-mounted-vehicle distance L1 necessary for a subsequent process. As a result, it is possible to appropriately perform a process for reducing a traffic jam based on the inter-system-mounted-vehicle distance L1.

In S109, when positional information for one system-mounted vehicle in front is obtained (No in S501), as described above, the ECU 20 may set the position of one system-mounted vehicle as the reference position Z (S529).

(Second Embodiment)

Figure 6:
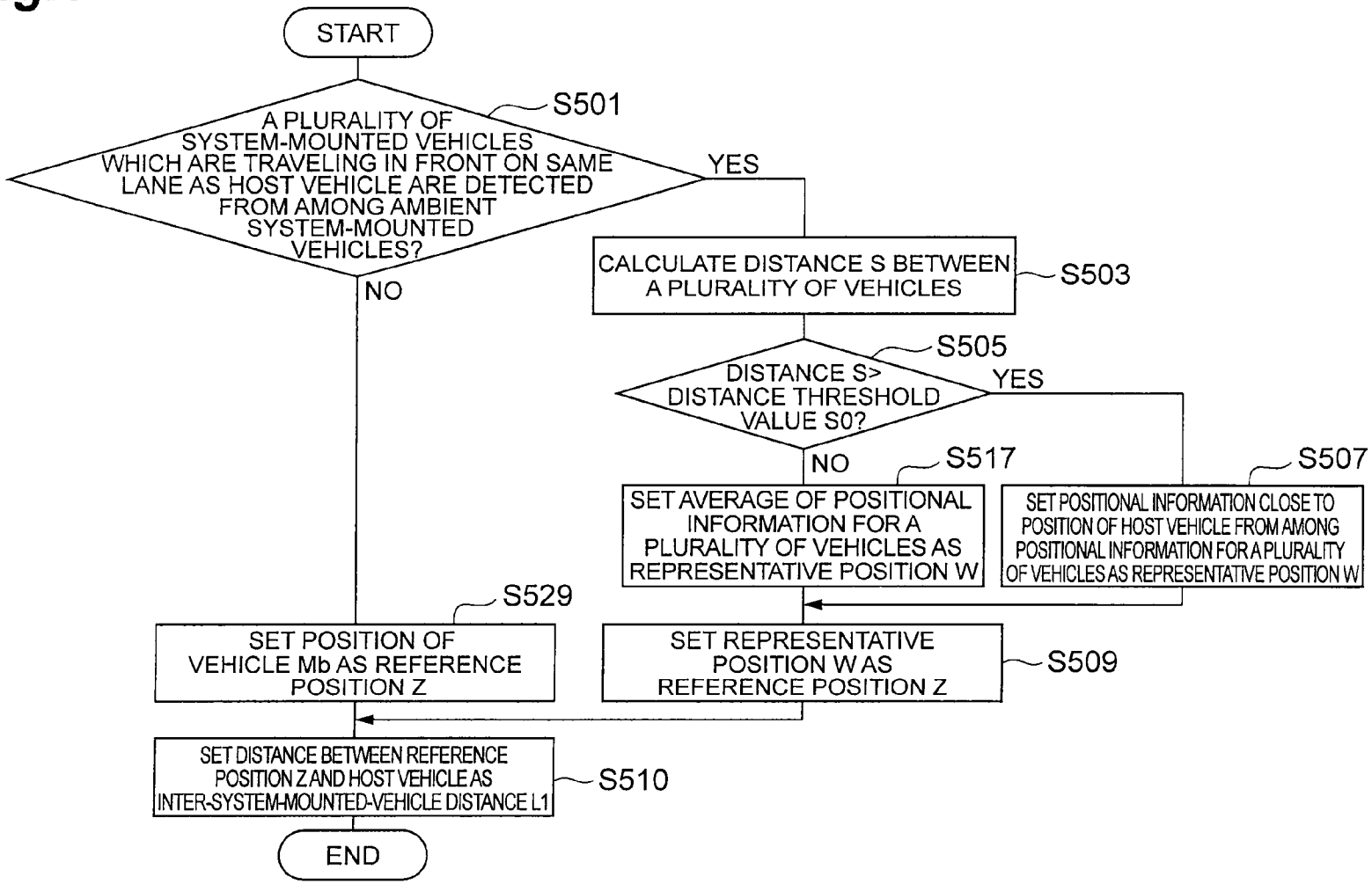
FIG. 6 is a flowchart showing an example of a process for determining an inter-system-mounted-vehicle distance L1.
Figure 8:
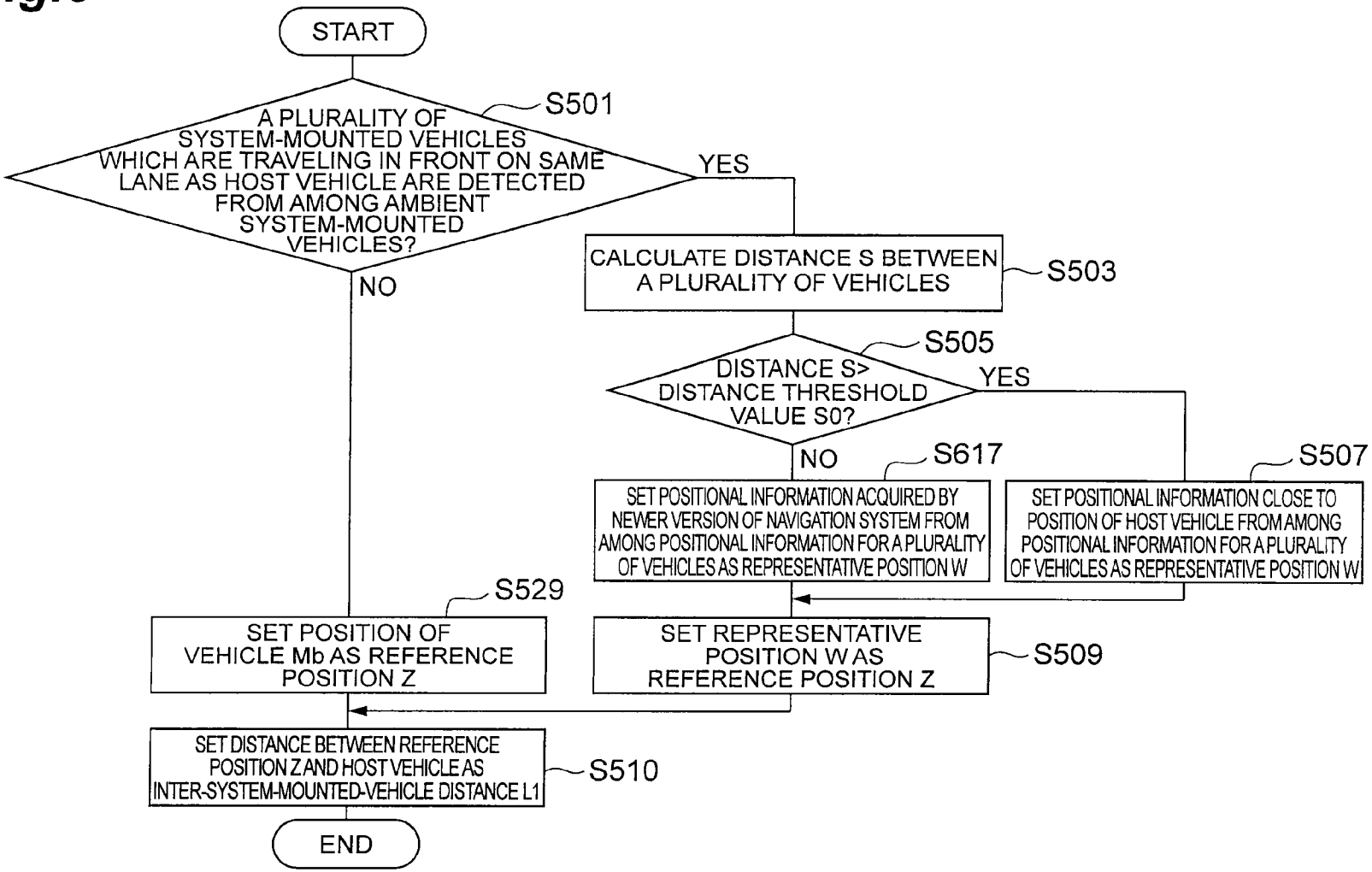
FIG. 8 is a flowchart showing another example of a process for determining an inter-system-mounted-vehicle distance L1.

As shown in FIG. 8, in a vehicle control system of this embodiment, instead of S517 of FIG. 6, S617 is performed. In this case, the ECU 20 sets positional information by the newer version of navigation system 16 from among the positional information Pj and Pk as the representative position W (S617). The representative position W is applied to the reference position Z (S509), the difference between the reference position Z and the position of the host vehicle Ma is applied to the above-described inter-system-mounted-vehicle distance L1 (S510), and the process from S111 of FIG. 3 is performed. That is, in this case, an attention vehicle candidate including the newer version of navigation system 16 from among the two attention vehicle candidates Mj and Mk is used as the above-described attention vehicle Mb. In order to enable such a determination process, version information of the navigation systems 16 is shared between the system-mounted vehicles by vehicle-to-vehicle communication.

In general, as the navigation system 16 is a newer version, the performance of the navigation system 16 is improved, and it is expected that positional information obtained has high precision. Thus, when positional information for a plurality of vehicles is obtained, positional information which is expected to have higher precision is set as the representative position W. Thus, it is possible to effectively use information obtained from the navigation system 16 having high precision from among the navigation systems 16 of a plurality of vehicles, thereby setting a more accurate inter-system-mounted-vehicle distance L1. As a result, the inter-vehicle distance at the sag 103 is optimized with high precision, thereby suppressing the occurrence of a traffic jam at the sag 103.

(Third Embodiment)

Figure 9:
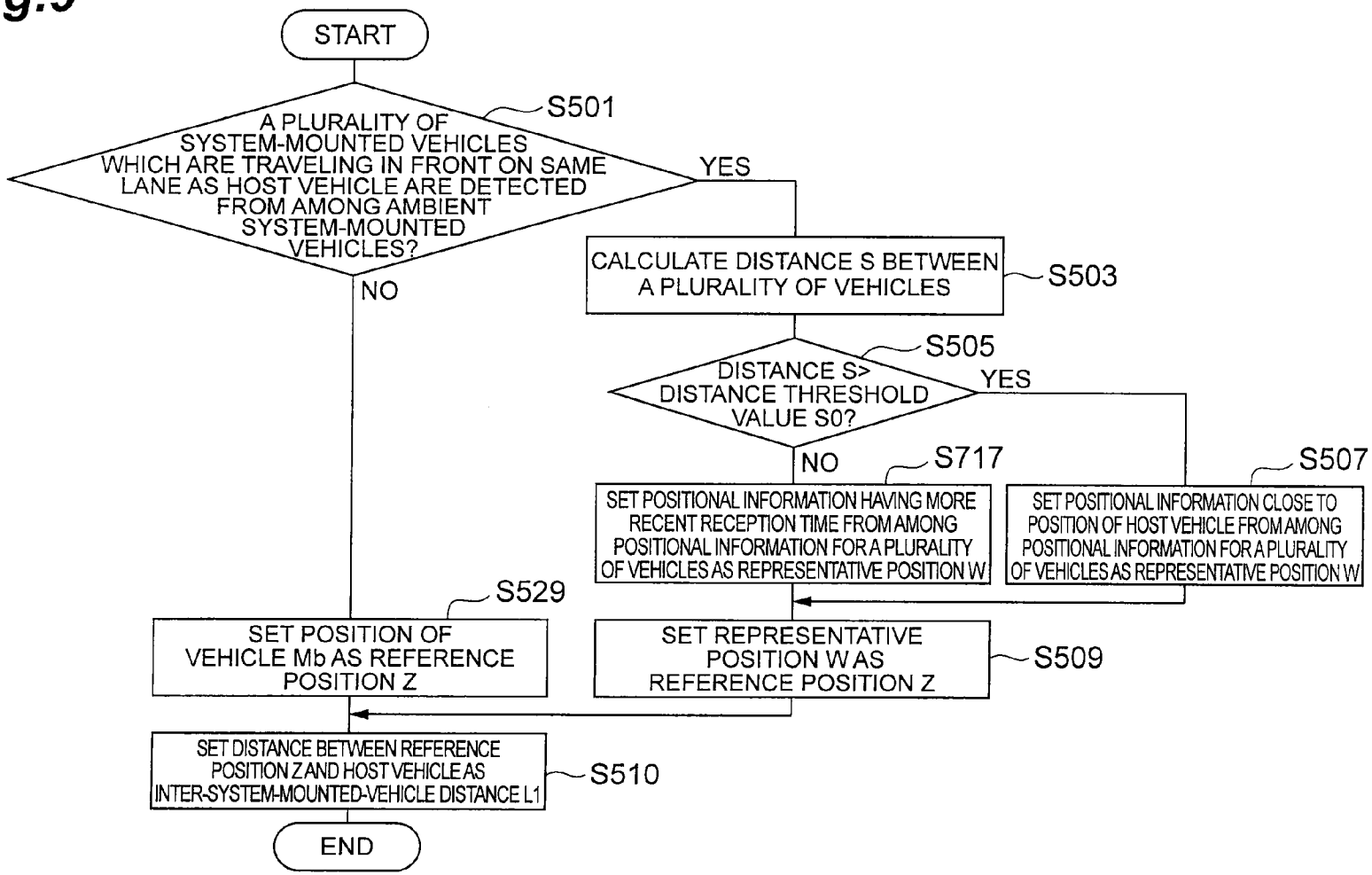
FIG. 9 is a flowchart showing another example of a process for determining an inter-system-mounted-vehicle distance L1.

As shown in FIG. 9, in a vehicle control system of this embodiment, instead of S517 of FIG. 6, S717 is performed. In this case, the ECU 20 sets positional information (newly received positional information) having a recent reception time from among the positional information Pj and Pk as the representative position W (S717). The representative position W is applied to the reference position Z (S509), the difference between the reference position Z and the position of the host vehicle Ma is applied to the above-described inter-system-mounted-vehicle distance L1 (S510), and the process from S111 of FIG. 3 is performed. That is, in this case, an attention vehicle candidate which transmits newer information from among positional information Pj and Pk for the two attention vehicle candidates Mj and Mk is used as the above-described attention vehicle Mb. In order to enable such a determination process, the ECU 20 of the host vehicle Ma stores the positional information of another vehicle received by vehicle-to-vehicle communication in association with the reception time of the positional information.

According to this process, when positional information for a plurality of vehicles is obtained, newer positional information is set as the representative position W, thereby setting an accurate inter-system-mounted-vehicle distance L1 based on new positional information. As a result, the inter-vehicle distance at the sag 103 is optimized with high precision, thereby suppressing the occurrence of a traffic jam at the sag 103.

Industrial Applicability

The invention relates to a vehicular information processing device which performs a predetermined process of a host vehicle on the basis of reference positional information acquired from positional information of another vehicle within a predetermined positional range, having an advantage of specifying a positional information of another vehicle necessary for the predetermined process even when there are a plurality of other vehicles within a predetermined range.

Reference Signs List

10: vehicle control system (vehicular information processing device), Ma: host vehicle, Mb, Mj, Mk: system-mounted vehicle (another vehicle), W: representative position, Z: reference position.

The invention claimed is:

1. A vehicular information processing device provided with a processing means which performs a predetermined process of a host vehicle on the basis of reference positional information acquired from positional information of another vehicle within a predetermined positional range, comprising:

a representative positional information acquisition means that, when there are a plurality of other vehicles within the predetermined positional range, acquires representative positional information on the basis of a plurality of pieces of positional information obtained from the plurality of other vehicles, wherein the processing means performs the predetermined process with the acquired representative positional information as the reference positional information, and the representative positional information acquisition means acquires the representative positional information by averaging a plurality of pieces of positional information acquired from the plurality of other vehicles.

2. The vehicular information processing device according to claim 1, further comprising a vehicle-to-vehicle communication means that enables communication between the host vehicle and another vehicle, wherein the representative positional information acquisition means acquires the positional information of another vehicle by vehicle-to-vehicle communication with another vehicle via the vehicle-to-vehicle communication means.

3. A vehicular information processing device provided with a processing means which performs a predetermined process of a host vehicle on the basis of reference positional information acquired from positional information of another vehicle within a predetermined positional range, comprising:

a representative positional information acquisition means that, when there are a plurality of other vehicles within the predetermined positional range, acquires representative positional information on the basis of a plurality of pieces of positional information obtained from the plurality of other vehicles, wherein the processing means performs the predetermined process with the acquired representative positional information as the reference positional information, and the representative positional information acquisition means, when the distance between the plurality of other vehicles is equal to or smaller than a predetermined distance, acquires the representative positional information by averaging a plurality of pieces of positional information obtained from the plurality of other vehicles, and when the distance between the plurality of other vehicles is larger than the predetermined distance, acquires positional information closest to the host vehicle from among the plurality of pieces of positional information as the representative positional information.

4. The vehicular information processing device according to claim 3, further comprising a vehicle-to-vehicle communication means that enables communication between the host vehicle and another vehicle, wherein the representative positional information acquisition means acquires the positional information of another vehicle by vehicle-to-vehicle communication with another vehicle via the vehicle-to-vehicle communication means.

5. A vehicular information processing device provided with a processing means which performs a predetermined process of a host vehicle on the basis of reference positional information acquired from positional information of another vehicle within a predetermined positional range, comprising:

a representative positional information acquisition means that, when there are a plurality of other vehicles within the predetermined positional range, acquires representative positional information on the basis of a plurality of pieces of positional information obtained from the plurality of other vehicles, wherein the processing means performs the predetermined process with the acquired representative positional information as the reference positional information, and the representative positional information acquisition means, when the distance between the plurality of other vehicles is equal to or smaller than a predetermined distance, on the basis of the precision of each of a plurality of pieces of positional information obtained from the plurality of other vehicles, acquires positional information which is expected to have the highest precision from among the plurality of pieces of positional information as the representative positional information, and when the distance between the plurality of other vehicles is larger than the predetermined distance, acquires positional information closest to the host vehicle from among the plurality of pieces of positional information as the representative positional information.

6. The vehicular information processing device according to claim 5, further comprising a vehicle-to-vehicle communication means that enables communication between the host vehicle and another vehicle, wherein the representative positional information acquisition means acquires the positional information of another vehicle by vehicle-to-vehicle communication with another vehicle via the vehicle-to-vehicle communication means.

7. A vehicular information processing device provided with a processing means which performs a predetermined process of a host vehicle on the basis of reference positional information acquired from positional information of another vehicle within a predetermined positional range, comprising:

a representative positional information acquisition means that, when there are a plurality of other vehicles within the predetermined positional range, acquires representative positional information on the basis of a plurality of pieces of positional information obtained from the plurality of other vehicles, wherein the processing means performs the predetermined process with the acquired representative positional information as the reference positional information, and the representative positional information acquisition means, when the distance between the plurality of other vehicles is equal to or smaller than a predetermined distance, on the basis of the timing of acquiring each of a plurality of pieces of positional information obtained from the plurality of other vehicles, acquires positional information having the most recent acquisition time from among the plurality of pieces of positional information as the representative positional information, and when the distance between the plurality of other vehicles is larger than the predetermined distance, acquires positional information closest to the host vehicle from among the plurality of pieces of positional information as the representative positional information.

8. The vehicular information processing device according to claim 7, further comprising a vehicle-to-vehicle communication means that enables communication between the host vehicle and another vehicle, wherein the representative positional information acquisition means acquires the positional information of another vehicle by vehicle-to-vehicle communication with another vehicle via the vehicle-to-vehicle communication means.

* * * * *